US007979917B2

(12) United States Patent
Osborne

(10) Patent No.: US 7,979,917 B2
(45) Date of Patent: Jul. 19, 2011

(54) REAR BREAK AWAY BALLISTICS VEST

(75) Inventor: Kurt J. Osborne, Charlotte, NC (US)

(73) Assignee: Survival Armor, Inc., Fort Myers, FL (US)

( * ) Notice: Subject to any disclaimer, the term of this patent is extended or adjusted under 35 U.S.C. 154(b) by 878 days.

(21) Appl. No.: 11/745,528

(22) Filed: May 8, 2007

(65) Prior Publication Data

US 2010/0005555 A1 Jan. 14, 2010

(51) Int. Cl.
*F41H 1/02* (2006.01)
*F41H 1/00* (2006.01)

(52) U.S. Cl. ..... 2/2.5; 89/36.05

(58) Field of Classification Search ..... 2/2.5
See application file for complete search history.

(56) References Cited

U.S. PATENT DOCUMENTS

| | | | | | |
|---|---|---|---|---|---|
| 2,052,684 | A | * | 9/1936 | Wisbrod | 2/2.5 |
| 2,748,391 | A | * | 6/1956 | Lewis, Jr. et al. | 2/2.5 |
| 3,337,875 | A | * | 8/1967 | Blakeney | 2/2.5 |
| 3,452,362 | A | * | 7/1969 | Korolick et al. | 2/2.5 |
| 3,634,889 | A | * | 1/1972 | Rolsten | 2/2.5 |
| 3,793,648 | A | * | 2/1974 | Dorre et al. | 2/2.5 |
| 3,873,998 | A | * | 4/1975 | Norris et al. | 2/2.5 |
| 4,483,020 | A | * | 11/1984 | Dunn | 2/2.5 |
| 4,535,478 | A | * | 8/1985 | Zufle | 2/2.5 |
| H7 | H | | 1/1986 | Martone | |
| 4,633,756 | A | * | 1/1987 | Rudoi | 89/36.02 |
| 5,044,011 | A | * | 9/1991 | Henderson | 2/2.5 |
| 5,060,314 | A | | 10/1991 | Lewis | |
| 5,072,453 | A | * | 12/1991 | Widder | 2/2.5 |
| 5,966,747 | A | | 10/1999 | Crupi et al. | |
| D429,384 | S | | 8/2000 | Crupi et al. | |
| 6,769,137 | B2 | | 8/2004 | D'Annunzio | |
| 6,948,188 | B2 | | 9/2005 | D'Annunzio | |
| 7,020,897 | B2 | | 4/2006 | Johnson | |
| 7,047,570 | B2 | * | 5/2006 | Johnson | 2/102 |
| 7,266,850 | B1 | * | 9/2007 | Strum et al. | 2/2.5 |
| 2002/0120973 | A1 | * | 9/2002 | D'Annunzio | 2/92 |
| 2003/0037812 | A1 | * | 2/2003 | Stewart et al. | 135/96 |
| 2004/0221361 | A1 | * | 11/2004 | D'Annunzio | 2/69 |
| 2005/0005342 | A1 | * | 1/2005 | Johnson | 2/102 |
| 2005/0005343 | A1 | * | 1/2005 | Johnson | 2/102 |
| 2007/0107109 | A1 | * | 5/2007 | Johnson | 2/102 |
| 2008/0098500 | A1 | * | 5/2008 | Matic et al. | 2/2.5 |
| 2008/0235841 | A1 | * | 10/2008 | McDunn et al. | 2/2.5 |
| 2008/0295210 | A1 | * | 12/2008 | Matic et al. | 2/2.5 |

* cited by examiner

*Primary Examiner* — Bobby H Muromoto, Jr.
(74) *Attorney, Agent, or Firm* — The Livingston Firm; Edward M. Livingston, Esq.; Bryan L. Loeffler, Esq.

(57) ABSTRACT

A rear break away ballistics vest (1) having a front section (36) and a back section (11) that are securable to one another. The front section (36) has a first side front section (16), a second side front section (17) and an upper front section (18). The back section (11) has a first side back section (13), a second side back section (14) and a back section cover (12) secured to the back section (11). A release strap (44) is located on the front section (36) to permit a user to quickly and easily remove the rear break away ballistics vest (1) with one hand. A first shoulder strap (4) and a second shoulder strap (5) are connected to the front section (36) and extend to the back section (11). A first clip (38) is located on the back section (11) to release the first shoulder strap (4) from the first clip (38). Similarly, a second clip (39) is located on the back section (11) to release the second shoulder strap (5) from the second clip (39).

8 Claims, 3 Drawing Sheets

REAR BREAK AWAY BALLISTICS VEST

BACKGROUND OF THE INVENTION

This invention relates to ballistics vests, more particularly, a rear break away ballistics vest that permits a user to quickly and easily remove the ballistics vest with one hand.

Currently, ballistics vests, which are also referred to as bullet-proof vests or armored vests, comprise three main components: a ballistics vest pad having body-face side and an opposing strike-face side, a non-removable cover (which is also referred to as a pad cover) and a carrier. When a person desires to use the armored vest, he or she inserts the covered ballistics vest pad into the carrier. Then, if the carrier is in the form of a jacket, a first arm is inserted into a first armhole and a second arm is inserted into a second armhole. If the carrier is in the form of an over-the-head type carrier, the person places his/her arms through the armholes and head through the head hole in order to wear the carrier. The carrier is then worn underneath or over the person's clothing. Therefore, in order to remove the ballistics vest, the user must first take off the carrier, a process which is very time-consuming.

In the event the user of the ballistics vest is in an emergency situation requiring quick removal of the ballistics vest, for example, if the user is in water and the weight of the vest is too great, time is of the essence to the user of the vest in dire need to remove the vest.

In addition, the user may not always have the luxury of being able to use both arms or both hands for the removal of the ballistics vest, a situation that commonly occurs when the user is injured or otherwise occupied with another task.

Thus, a need exists for a ballistics vest that permits a user to quickly and easily remove the ballistics vest with one hand.

The relevant prior art includes the following references:

| Patent No. (U.S. unless stated otherwise) | Inventor | Issue/Publication Date |
|---|---|---|
| 2005/0005342 | Johnson | Jan. 13, 2005 |
| 7,047,570 | Johnson | May 23, 2006 |
| 2005/0005343 | Johnson | Jan. 13, 2005 |
| 7,020,897 | Johnson | Apr. 04, 2006 |
| 6,948,188 | D'Annunzio | Sep. 27, 2005 |
| H7 | Martone | Jan. 07, 1986 |
| 5,966,747 | Crupi et al. | Oct. 19, 1999 |
| Des. 429,384 | Crupi et al. | Aug. 08, 2000 |
| 5,060,314 | Lewis | Oct. 29, 1991 |
| 6,769,137 | D'Annunzio | Aug. 03, 2004 |

SUMMARY OF THE INVENTION

The primary object of the present invention is to provide a rear break away ballistics vest that permits a user to quickly remove the ballistics vest.

A further object of the present invention is to provide a rear break away ballistics vest that permits a user to easily remove the ballistics vest.

An even further object of the present invention is to provide a rear break away ballistics vest that permits a user to remove the ballistics vest with one hand.

The present invention fulfills the above and other objects by providing a rear break away ballistics vest having a front section and aback section that are securable to one another. The front section has a first side front section, a second side front section and an upper front section. The back section has a first side back section, a second side back section and a back section cover secured to the back section. A first shoulder strap and a second shoulder strap are connected to the front section and extend to the back section. A first release means, which is preferably a first clip, is located on the back section to release the first shoulder strap from the first release means. Similarly, a second release means is located on the back section to release the second shoulder strap from the second release means. A means for securing the first release means to the second release means, which is preferably a release strap, is located on the front section of the rear break away ballistics vest to permit a user to quickly and easily remove the rear break away ballistics vest with one hand.

To release the ballistics vest of the present invention from a user, the user lifts an upper flap located on the upper front section so as to gain access to a release strap handle. Then, he/she pulls the release strap handle in an outward direction so as to unsecure the release means (unclasping the clips), thereby permitting the first and second shoulder straps to disconnect from the first and second release means.

An additional embodiment of the present invention includes first and second cummerbunds secured to the front section of the rear break away ballistics vest. The cummerbunds include side straps that may also be secured to the release means and release strap. In this embodiment, when the release strap handle is pulled, the release means not only disconnect the first and second shoulder straps, but also the cummerbunds.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
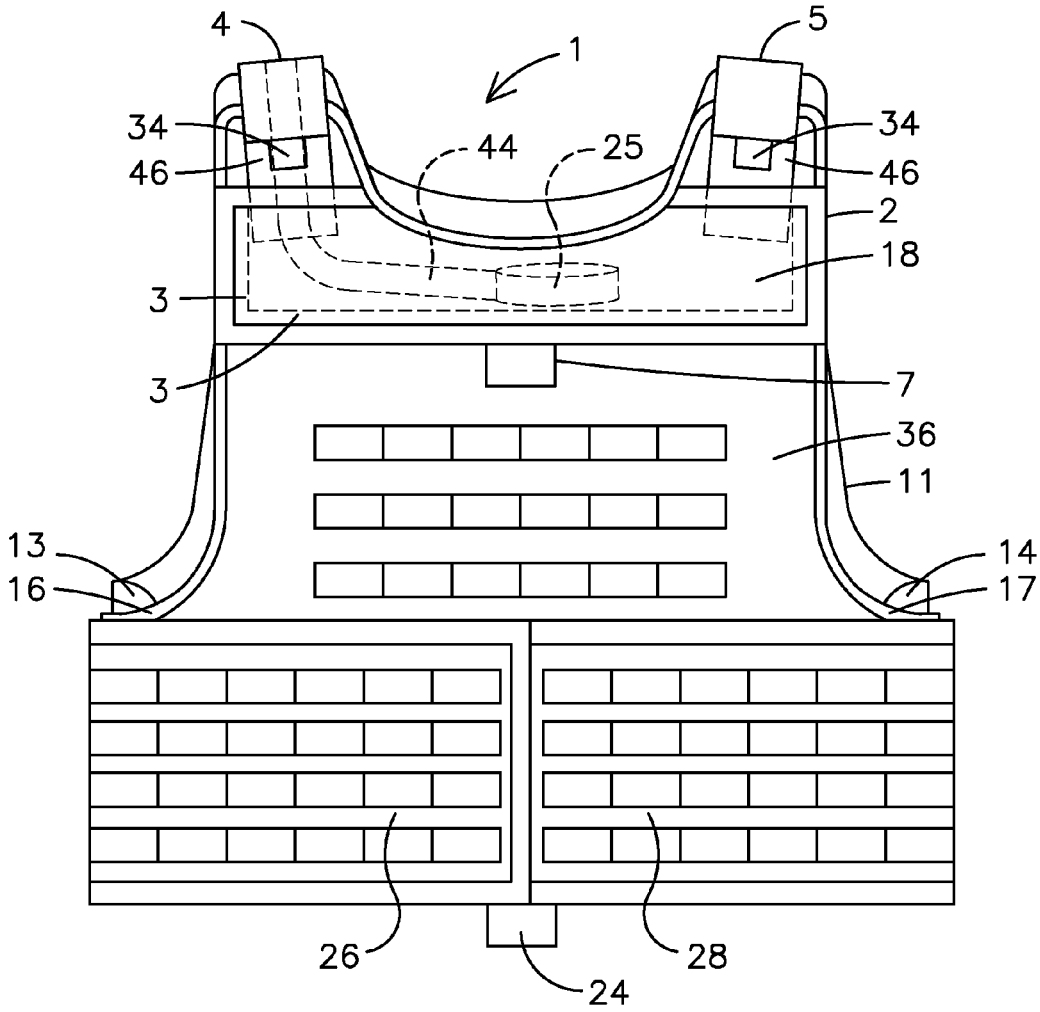
FIG. 1 is a front plan view of a rear break away ballistics vest of the present invention.

For purposes of describing the preferred embodiment, the terminology used in reference to the numbered components in the drawings is as follows:

| | |
|---|---|
| 1. | front break away ballistics vest, generally |
| 2. | upper flap |
| 3. | flap fastening means |
| 4. | first shoulder strap |
| 5. | second shoulder strap |
| 6. | first upper side strap |

-continued

| | |
|---|---|
| 7. | upper flap tab |
| 8. | first lower side strap |
| 9. | second upper side strap |
| 10. | second lower side strap |
| 11. | back section |
| 12. | back section cover |
| 13. | first side back section |
| 14. | second side back section |
| 15. | vest handle |
| 16. | first side front section |
| 17. | second side front section |
| 18. | upper front section |
| 19. | back section flap |
| 20. | ring |
| 21. | clip, generally |
| 22. | clip retaining means |
| 23. | pin pull |
| 24. | back section flap tab |
| 25. | release strap handle |
| 26. | first cummerbund |
| 27. | buckle |
| 28. | second cummerbund |
| 29. | clip ring |
| 30. | pin |
| 31. | clip first section |
| 32. | clip second section |
| 33. | joint |
| 34. | shoulder strap tab |
| 35. | shoulder strap adjustment means |
| 36. | front section |
| 37. | aperture |
| 38. | first clip |
| 39. | second clip |
| 40. | side strap strip |
| 41. | first release means |
| 42. | second release means |
| 43. | cord |
| 44. | release strap, generally |
| 45. | single-handed release system, generally |
| 46. | shoulder strap fastening means |

With reference to FIG. 1, a front plan view of a rear break away ballistics vest of the present invention is shown. The rear break away ballistics vest, generally 1, includes a front section 36 and a back section 11 joined together via a first shoulder strap 4 and a second shoulder strap 5. Each shoulder strap 4 and 5 preferably includes at least one shoulder strap tab 34 so as to permit a user to easily detach the shoulder strap 4 and 5 from a shoulder strap fastening means 46 and adjust the length of the shoulder strap 4 and 5. A release strap 44 preferably extends from the back section 11 to the front section 36 by extending through the first shoulder strap 4 and preferably includes a release strap handle 25. The front section 36 includes a first side front section 16 and a second side front section 17 while the back section 11 includes a first side back section 13 and a second side back section 14. In this manner, the first side front section 16 is securable to the first side back section 13 and the second side front section 17 is securable to the second side back section 14 so as to wrap around and protect the sides of a user of the rear break away ballistics vest 1. In addition, a first cummerbund 26 and a second cummerbund 28 are preferably secured to the front section 36 of the vest 1 and extend over the first side front section 16 and second side front section 17 so as to provide additional protection. An upper flap 2 is located on an upper portion of the front section 36 of the rear break away ballistics vest 1. The flap 2 is secured to the front section 36 such that a user may lift the flap 2 to expose an upper front section 18 of the vest 1, thereby providing access to the release strap 44 and release strap handle 25. For ease of use, the upper flap 2 preferably includes at least one upper flap tab 7 to permit a user to grasp the tab 7 to raise the flap 2. Flap fastening means 3 are preferably located on an underside of the flap 2 so as to retain the flap 2 against the upper front section 18.

Figure 2:
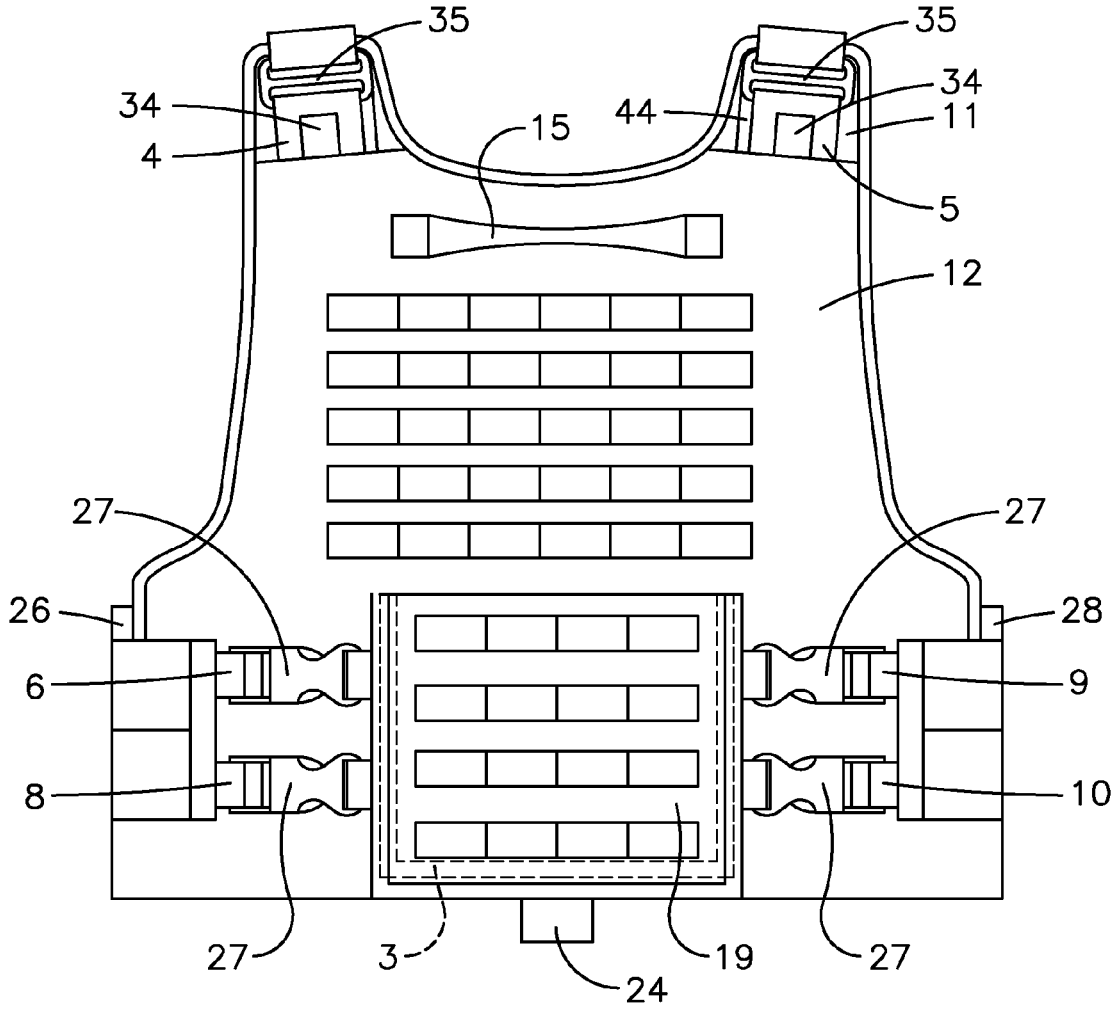
FIG. 2 is a rear plan view of a rear break away ballistics vest of the present invention.
Figure 4:
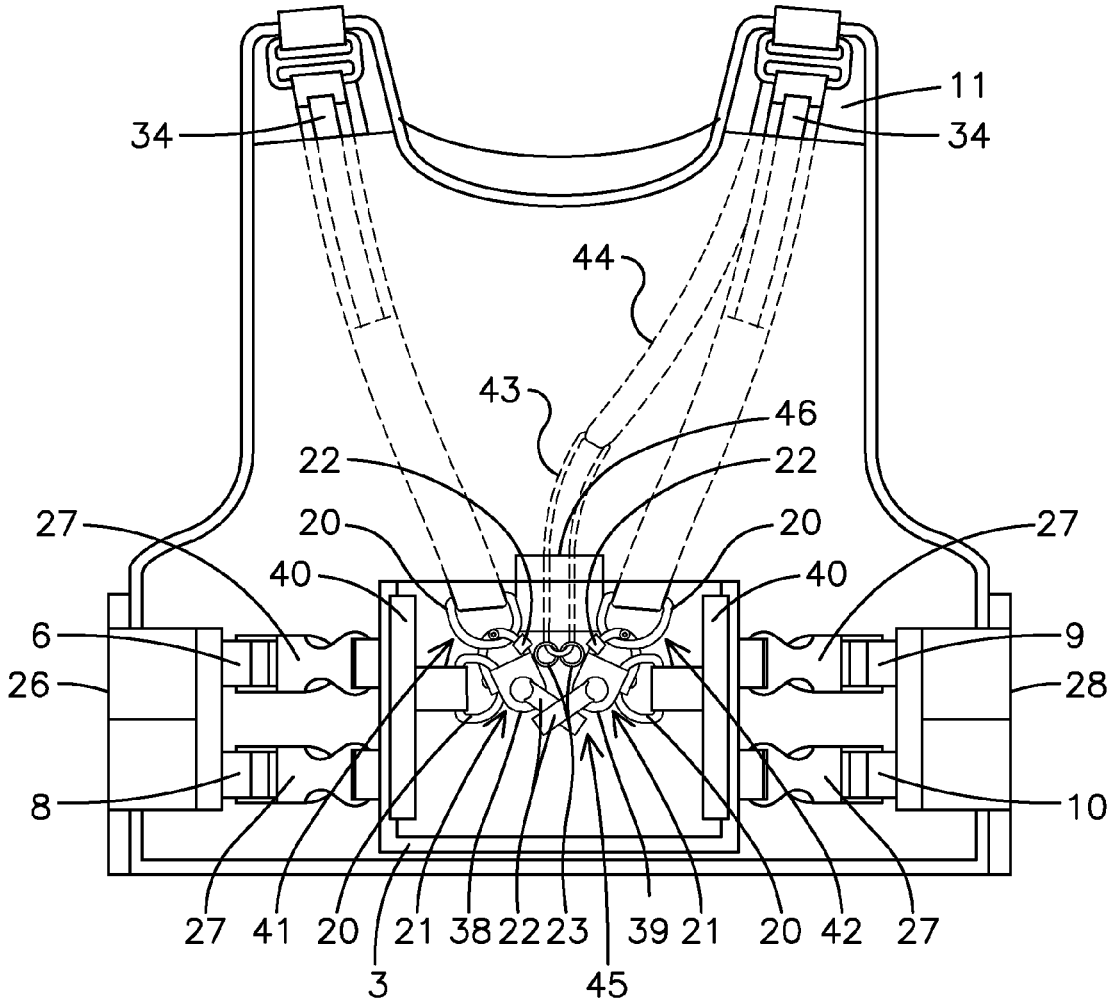
FIG. 4 is a rear plan view of a rear break away ballistics vest of the present invention without a lower flap.

In FIG. 2, a rear view of a rear break away ballistics vest of the present invention is shown. The back section 11 of the rear break away ballistics vest 1 preferably includes a vest handle 15 to permit a user to easily carry and store the vest 1. A back section cover 12 covers a substantial portion of the back section 11 so as to conceal the single-handed release system 45 (as shown in FIG. 4). Each shoulder strap 4 and 5 is preferably connected to a shoulder strap adjustment means 35 to permit a user to adjust the length of the shoulder straps 4 and 5. At least one shoulder strap tab 34 is preferably secured to each shoulder strap 34 to permit a user to easily remove the shoulder straps 4 and 5 from in between the back section 11 and back section cover 12. A back section flap 19 is secured to the back section cover 12 and preferably includes a flap fastening means 3 located on the underside of the back section flap 19 to maintain the back section flap 19 secured to the back section cover 12. A back section flap tab 24 is preferably secured to the back section flap 19 to permit a user to easily lift the back section flap 19 when desired. The back section flap 19 conceals the single-handed release system 45, as shown and described in detail in conjunction with FIG. 4. If first and second cummerbunds 26 and 28 are being used in conjunction with the rear break away ballistics vest 1 of the present invention, the first cummerbund 26 preferably includes a first upper side strap 6 and a first lower side strap 8 while the second cummerbund 28 preferably includes a second upper side strap 9 and a second lower side strap 10. Each side strap 6, 8, 9 and 10 is preferably secured to a buckle 27 to permit a user to adjust the fit of the cummerbunds 26 and 28.

Figure 3:
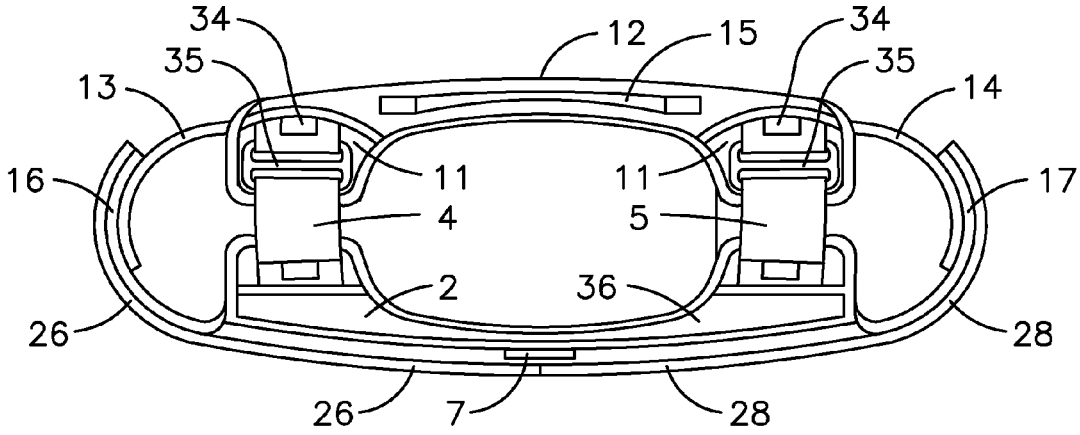
FIG. 3 is a top view of a rear break away ballistics vest of the present invention.

With reference to FIG. 3, a top view of a rear break away ballistics vest of the present invention is shown. The first shoulder strap 4 and second shoulder strap 5 are preferably adjustable via a shoulder strap adjustment means 35 so as to provide a tailored fit for the user. The shoulder straps 4 and 5 preferably are located between the back section 11 and the back section cover 12 and extend to the front section 36. The first side back section 13 and second side back section 14 extend towards the front section 36 and secure to first side front section 16 and second side front section 17, respectively. If first and second cummerbunds 26 and 28 are being used, the first cummerbund 26 extends over the first side front section 16 and is preferably secured thereto while the second cummerbund 28 extends over the second side front section 17 and is preferably secured thereto.

Next, FIG. 4 shows a rear plan view of a rear break away ballistics vest of the present invention without the back section flap 19 of FIG. 2 so as to show components of the single-handed release system. The rear break away ballistics vest 1 of the present invention includes a single-handed release system, generally 45 to permit a user to quickly and easily remove the vest 1 with one hand. The single-handed release system 45 includes a first release means 41 and a second release means 42 joined together, preferably via a cord 43 connected to the release strap 44. The release means 41 and 42 are preferably clips 21 that are able to be opened, which are shown in greater detail in FIG. 5. Each clip 21 is secured to the ballistics vest 1, preferably via a clip retaining means 22, so as to retain the clips 21 on the vest 1, even when the clips 21 are opened. Each clip 21 also includes a pin pull 23 which permits the clip 21 to open when the pin pull 23 is pulled.

Each shoulder strap 4 and 5 includes a shoulder strap tab 34 to permit a user to easily grasp the shoulder strap 4 and 5 if needed to remove the shoulder strap 4 and 5 from in between the back section 11 and the back section cover 12. A ring 20, which is preferably a D-ring, is secured at a bottom of each shoulder strap 4 and 5.

Similarly, the first upper side strap 6, the first lower side strap 8, the second upper side strap 9 and the second lower side strap 10 are provided for permitting a customized fit of the vest 1 around the torso of a user if cummerbunds 26 and 28 are used. The first upper side strap 6 and the first lower side strap 8 are preferably connected to a side strap strip 40. In addition, the second upper side strap 9 and the second lower side strap 10 are also preferably connected to a side strap strip 40. Each side strap strip 40 is preferably connected to a ring 20.

Each ring 20 is secured within a clip 21 for maintaining the shoulder straps 4 and 5 and side straps 6, 8, 9 and 10 in connection with the single-handed release system 45. Each pin pull 23 is secured to a release strap, generally 44, preferably via a cord 43. A release strap handle 25, which is located on the front section 36, is preferably provided to permit a user to remove the pin pulls 23 from the clips 21 attached to the shoulder straps 4 and 5 and attached to the side straps 6, 8, 9 and 10 with one pull. When the release strap handle 25 is pulled, the pin pulls 23 for the clips 21 attached to the shoulder straps 4 and 5 move in an upward manner. When the pin pulls 23 are released from the clips 21, the shoulder straps 4 and 5 and side straps 6, 8, 9 and 10 are released, the back section 11 and the cummerbunds 26 and 28 are no longer connected to the front section 36, thereby allowing the vest 1 to fall off of the user.

At least flap fastening means 3, which corresponds to the flap fastening means 3 located on the underside of the back section flap 19, retains the back section flap 19 on the back cover section 12.

Figure 5:
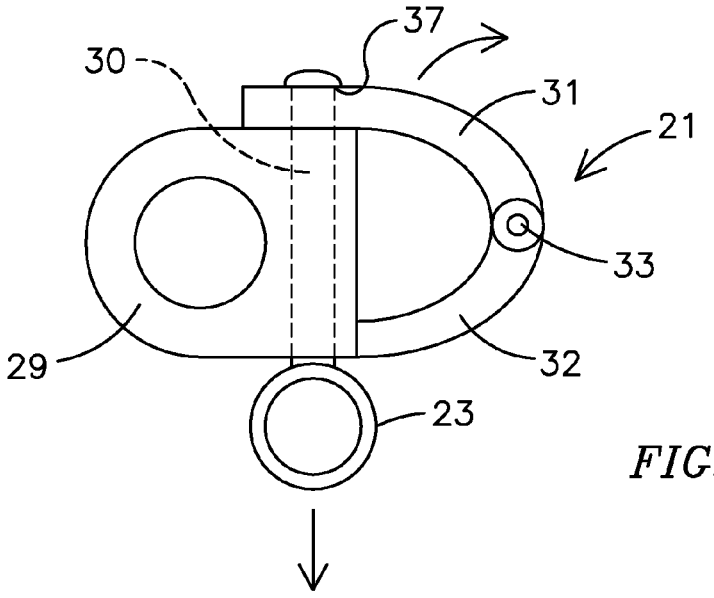
FIG. 5 is a side view of a clip used in conjunction with a rear break away ballistics vest of the present invention.
Figure 6:
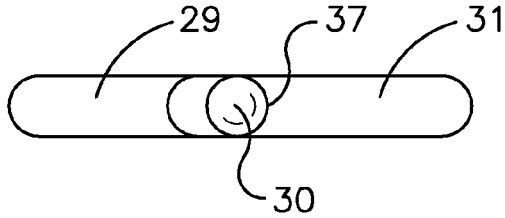
FIG. 6 is a top view of the embodiment of FIG. 5.

In FIGS. 5 and 6, varying views of a clip used in conjunction with a rear break away ballistics vest of the present invention is shown. The clip 21 includes a clip ring 29, a clip first section 31, a clip second section 32 and a pin 30 having a pin pull 23 attached thereto. The clip first section 31 is pivotally connected to the clip second section 32 along a joint 33. The pin 30 extends through the clip ring 29 and is inserted into an aperture 37 on the clip first section 31. When the pin pull 23 is pulled, the pin 30 is removed from the aperture 37, thereby permitting the clip first section 31 to open.

Figure 7:
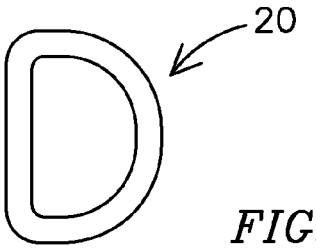
FIG. 7 is a side view of a ring of a rear break away ballistics vest of the present invention.

Finally, FIG. 7 shows a side view of a ring of a rear break away ballistics vest of the present invention. The ring 20 is preferably in the shape of a D-ring, although other shapes may also be used.

The use of the present invention will permit a user to quickly and easily remove the rear break away ballistics vest 1 with one hand.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A rear break away ballistics vest comprising:

a front section and a back section wherein said front section is securable to said back section;

said front section having a first side front section and a second side front section;

said front section having an upper front section;

said back section having a first side back section and a second side back section;

said back section having a back section cover secured to said back section;

a first shoulder strap connected to said front section and extending to said back section;

a second shoulder strap connected to said front section and extending to said back section;

at least one clip located on the back section;

said at least one clip having a first section pivotally attached to the at least one clip for opening and closing said at least one clip and a pin extending through an aperture located in the clip and the first section of the clip for locking the first section in a closed position;

said first shoulder strap is removably attached to the at least one clip;

said second shoulder strap is removably attached to the at least one clip; and a release strap attached to the pin of the at least one clip for disengaging the pin from the first section, thereby opening the at least one clip and releasing the first shoulder strap and the second shoulder strap from the at least one clip.

2. The rear break away ballistics vest of claim 1 further comprising:

a first cummerbund secured to said front section; and said first cummerbund having at least one side strap removably attached to the at least one clip.

3. The rear break away ballistics vest of claim 2 further comprising:

a second cummerbund secured to said front section; and said second cummerbund having at least one side strap removably attached to the at least one clip, at least one means for securing said at least one side strap to said second release means.

4. A rear break away ballistics vest comprising:

a front section and a back section wherein said front section is securable to said back section;

said front section having a first side front section and a second side front section;

said front section having an upper front section;

said back section having a first side back section and a second side back section;

said back section having a back section cover secured to said back section;

a first shoulder strap connected to said front section and extending to said back section;

a second shoulder strap connected to said front section and extending to said back section;

at least one clip located on the rear section;

said at least one clip having a first section pivotally attached to the at least one clip for opening and closing said at least one clip and a pin extending through an aperture located in the clip and the first section of the clip for locking the first section in a closed position;

said first shoulder strap is removably attached to the at least one clip;

said second shoulder strap is removably attached to the at least one clip;

a first cummerbund secured to said front section;

said first cummerbund having at least one side strap removably attached to the at least one clip;

a second cummerbund secured to said front section;

said second cummerbund having at least one side strap removably attached to the at least one clip; and a release strap attached to the pin of the at least one clip for disengaging the pin from the first section, thereby opening the at least one clip and releasing the first shoulder strap, the second shoulder strap, the first cummerbund and the second cummerbund from the at least one clip.

5. The rear break away ballistics vest of claim 4 further comprising:

a flap partially removably secured to said front section.

6. The rear break away ballistics vest of claim 4 further comprising:

a flap partially removably secured to said back section.

7. The rear break away ballistics vest of claim 4 further comprising:

a release strap handle connected to said release strap.

8. A rear break away ballistics vest comprising:

a front section and a back section wherein said front section is securable to said back section;

said front section having a first side front section and a second side front section;

said front section having an upper front section;

said back section having a first side back section and a second side back section;

said back section having a back section cover secured to said back section;

a first shoulder strap connected to said front section and extending to said back section;

a second shoulder strap connected to said front section and extending to said back section;

at least one clip located on the rear section;

said at least one clip having a first section pivotally attached to the at least one clip for opening and closing said at least one clip and a pin extending through an aperture located in the clip and the first section of the clip for locking the first section in a closed position;

said first shoulder strap is removably attached to the at least one clip via a ring;

said second shoulder strap is removably attached to the at least one clip via a ring;

a first cummerbund secured to said front section;

said first cummerbund having at least one side strap removably attached to the at least one clip via a ring;

a second cummerbund secured to said front section;

said second cummerbund having at least one side strap removably attached to the at least one clip via a ring; and a release strap attached to the pin of the at least one clip for disengaging the pin from the first section, thereby opening the at least one clip and releasing the ring of the first shoulder strap, the ring of the second shoulder strap, the ring of the first cummerbund and the ring of the second cummerbund from the at least one clip.

* * * * *